US008453898B2

(12) United States Patent
Ewins

(10) Patent No.: US 8,453,898 B2
(45) Date of Patent: Jun. 4, 2013

(54) DETACHABLE POUCH

(75) Inventor: Neil Ewins, New South Whales (AU)

(73) Assignee: FNG IP Holdings Pty Ltd, New South Wales (AU)

( * ) Notice: Subject to any disclaimer, the term of this patent is extended or adjusted under 35 U.S.C. 154(b) by 762 days.

(21) Appl. No.: 11/721,267

(22) PCT Filed: Dec. 9, 2005

(86) PCT No.: PCT/AU2005/001859
§ 371 (c)(1),
(2), (4) Date: Jun. 25, 2009

(87) PCT Pub. No.: WO2006/060869
PCT Pub. Date: Jun. 15, 2006

(65) Prior Publication Data

US 2009/0261138 A1 Oct. 22, 2009

(30) Foreign Application Priority Data

Dec. 9, 2004 (AU) ..... 2004907037

(51) Int. Cl.
*A45F 5/00* (2006.01)

(52) U.S. Cl.
USPC ..... 224/675; 224/677; 224/901.4

(58) Field of Classification Search
USPC ..... 224/148.6, 587, 660, 674, 675, 677, 224/665, 901.4, 901.2, 901.8
See application file for complete search history.

(56) References Cited

U.S. PATENT DOCUMENTS

| | | | | |
|---|---|---|---|---|
| 3,450,317 | A | 6/1969 | Ramer | |
| 4,139,914 | A * | 2/1979 | Tarr | 2/247 |
| 4,174,793 | A * | 11/1979 | Wisowaty | 224/240 |
| 4,372,468 | A | 2/1983 | Harvey | |
| 4,676,419 | A * | 6/1987 | Victor | 224/649 |
| 4,907,729 | A * | 3/1990 | Hess, III | 224/682 |
| 5,195,667 | A | 3/1993 | Gallant | |
| 5,573,167 | A | 11/1996 | Bebb et al. | |
| 5,944,242 | A | 8/1999 | Musarella et al. | |
| 6,102,264 | A | 8/2000 | Redzisz | |
| 6,412,674 | B1 * | 7/2002 | Lipke | 224/240 |
| 6,497,352 | B2 | 12/2002 | Grover | |
| 7,770,770 | B2 * | 8/2010 | Murdoch et al. | 224/672 |
| 2002/0003155 | A1 | 1/2002 | Holland et al. | |
| 2003/0094470 | A1 * | 5/2003 | Cragg | 224/236 |
| 2004/0079776 | A1 | 4/2004 | Bauer | |
| 2009/0302076 | A1 * | 12/2009 | Romano et al. | 224/199 |

FOREIGN PATENT DOCUMENTS

DE 3825195 4/1989

* cited by examiner

*Primary Examiner* — Justin Larson
(74) *Attorney, Agent, or Firm* — Stites & Harbison PLLC; Douglas E. Jackson

(57) ABSTRACT

An adaptor (1) for fitting to a waist band, the adaptor comprising: an adaptor body having first (3) and second (5) ends. The first end is adapted to receive and retain a pouch (4) and the second end terminates in a fastening assembly. The adaptor body includes a first face (14) and an opposing face (20); wherein the second end comprises at least one fastener (13), the adaptor body formed from a flexible material allowing a portion of the second end to be folded about the waist band. A portion of the second face folds back on itself allowing a portion of the first face to meet at least a portion of the second face in opposing engagement.

28 Claims, 3 Drawing Sheets

DETACHABLE POUCH

BACKGROUND

The present invention relates to pouches for carrying objects such as but not limited to hand held tools and more particularly relates to a pouch capable of detachable attachment to a supporting member such but not limited to a belt.

More particularly, the present invention relates to an adaptor for attaching a pouch to a belt or the like and a method of retaining the pouch to a waist belt.

Although the invention will be described with reference to its application as a pouch for carrying tools it will be recognised that the adaptor has a variety of applications not limited to that to be described.

PRIOR ART

There are already in existence a number of arrangements which allow detachable attachment of objects such as tools and the like to builder holsters. Tradesman in the building industry have long required means for holding a variety of tools and hardware which are required repetitively.

Numerous innovations for tool holding devices have been provided in the prior art that are described as follows. Even though these innovations may be suitable for the specific individual purposes to which they address, they differ from the present invention as hereinafter contrasted.

As an example of the prior art, U.S. Pat. No. 6,497,352 discloses a locking tool holder which comprises a base plate having features enabling mounting on a person's belt or pocket. A cradling device is adapted for receiving a hand tool and for clamping the hand tool. A biasing device is adapted for moving the tool clamping device between a tool receiving position and a tool clamping position so as to make the tool available for use and to place the tool within reach when it is needed respectively. When the tool is removed from the clamping device the it is automatically unclamped. When the tool is placed into the clamping device it is automatically clamped in place.

Devices of this type are quite mechanically complicated and expensive to manufacture.

U.S. Pat. No. 6,102,264 discloses a tool holder for a tool belt including a closed loop comprised of a rod with spaced ends and a bridging element between the spaced ends. The loop typically is closed with the head of the tool retained by the loop and handle fitting through the loop. The handle of the tool may, however, be pivoted to release the bridging section from closing the loop thereby enabling the tool to be removed from the loop. Typically, the holder is mounted on the tool belt and provides a relatively inexpensive, yet reliable manner and construction for maintaining the tool in position ready for use, yet safely retained.

U.S. Pat. No. 5,944,242 discloses a tool holder for mounting on a user's belt comprising a support member having two front supports and two rear supports, each rear support having a rear top portion, a rear bottom portion, and a rear transition portion positioned therebetween. Each front support is spaced from and biased substantially parallel to the rear top portion and being nonparallel to the rear bottom portion. Each rear transition portion extends toward the front support to provide a narrow gap which is smaller than the spacing between the front support and rear top portion, with the rear supports being connected by a support cross member, and the rear bottom portions extending away from the front supports. Also, the rear bottom portions are of substantially the same length as the rear top portions. A bracket member is operatively associated with the front supports for holding a tool. Thus, when the tool holder is mounted on a user's belt, the front supports and rear transitions portions resistance to removal of the support member from the belt. This another quite complicated means for performing what is a relatively simple task and is desirable to perform the task of tool mounting in the simplest possible manner.

In another example of a known device, U.S. Pat. No. 5,195,667 describes a device for suspending T-shaped tools from a belt, toolbox, wall, or other mount, comprising a flat attachment material and a rotating holder body which secures the tool while allowing the tool to be inserted and removed from different angles. In order to ensure that the holder body stays in a useful position, its swing is limited by two stops which act as brakes and are affixed so as to protrude perpendicularly from the attachment material. The invention is designed so that after the tool is inserted into the holder, the head of the tool remains secured by the cantilevering action of a spring-loaded clip against a dead-lock arm extending downwards from the holder body. The opposite end of the tool rests on an L-shaped extending at right angles from the attachment material. The tool is removed by the natural motion of grasping the handle and swinging upwards. This results in the tool being held in an immediately usable manner as it is withdrawn from the holder.

U.S. Pat. No. 5,944,242 describes a tool holder for mounting on a user belt comprising a support member having two front supports and two rear supports, each rear support having a rear top portion, a rear bottom portion, and a rear transition portion positioned therebetween. Each front support is spaced from and biased substantially parallel to the rear top portion and being nonparallel to the rear bottom portion. Each rear transition portion extends toward the front support to provide a narrow gap which is smaller than the spacing between the front support and rear top portion, with the rear supports being connected by a support cross member, and the rear bottom portions extending away from the front supports. Also, the rear bottom portions are of substantially the same length as the rear top portions. A bracket member is operatively associated with the front supports for holding a tool. Thus, when the tool holder is mounted on a user belt, the front supports and rear transitions portions resistance to removal of the support member from the belt.

U.S. Pat. No. 4,372,468 describes a snap-lock device for securing and pivotally supporting a hammer or other similar tool from the user's waist belt. The device is comprised of a pad support which is suspended from the waist belt, an open ended tool support which is pivotally mounted on the pad for carrying the tool, and a pair of spring biased tool retention gates which are mounted on the open ends of the tool support loop for rapid lateral entry of the tool into the tool support loop and securing of the tool.

In yet a further example, U.S. Pat. No. 3,450,317 describes a tool holder for headed tools to be carried on the belt of a person. The holder consists of a plastic member having a portion for suspending from the belt, and including a bifurcated, semi circular portion extending from the belt holding portion. A two part locking member has one portion in the form of a square-shaped tab, which is secured at one end to the plastic member at the juncture of the belt portion and the bifurcated portion. The other end of the tab member has secured thereto to a second semicircular member, forming the other part of the locking member, the second semi-circular member being movable with the tab portion. The second semi-circular member receives the head of a tool and rotates along the plastic member, with the tab, allowing the handle of the tool to extend between the bifurcated portion with the second semi-circular member wrapping over the head of the tool, securely locking the tool in the holder.

U.S. Pat. No. 5,573,167 describes a method for using a holder having first and second clips arranged with their mouths facing substantially the same direction. The first clip is provided with an inner surface which is shaped to hold a cylindrical article and a mouth which is normally open so as to allow the legs of this first clip to be urged apart from each other when such a cylindrical article is pressed against it. The holder is mounted at a designated location on the user's body by attaching the second clip to a piece of material worn by the user, with the mouth of the first clip facing generally downwardly. A substantially cylindrical article is inserted into the first clip by placing the article against the mouth of this clip and lifting the article upwardly into contact with its inner surface, with the axis of the first clip's inner surface in a generally horizontal orientation. Preferably, the insertion of the article is performed by balancing it in one of the user's hands, placing the thumb of that hand on an upwardly facing surface of the holder and lifting the article into the first clip by pulling the article and thumb toward each other.

The prior art teaches various holding and gripping mechanisms, some of which have a locking component. Several of the locking mechanisms, however, apply to headed or T-shaped tools only such as hammers.

There is a need to provide a means to releasably attached tools and various other devices to a belt particularly for tradesmen. In addition there is a long felt want to provide a universal adaptor which will enable simple attachment to a belt or the like for the purpose of holding objects such as tools.

INVENTION

The present invention relates to pouches for carrying objects such as hand held tools and more particularly relates to a pouch capable of detachable attachment to a supporting member such as a belt.

More particularly, the present invention relates to an adaptor for attaching a pouch to a belt or the like. The present invention provides a useful alternative to the known devices.

Although the invention will be described with reference to its application as a pouch for carrying tools it will be recognised that the adaptor has a variety of applications not limited to that described.

The present invention seeks to provide an alternative to the known detachable attachments to waist belts so that tools and hardware may be used conveniently and repeatedly.

In its broadest form the present invention comprises:

an adaptor for fitting a pouch to a waist band the adaptor comprising:

a first member having first and second ends, the first end adapted to receive a pouch and the second end terminating in a second member, the first member including an inner face and an outer face, wherein the inner face includes a part which folds back-on itself to allow engagement of opposing fasteners;

wherein said second member engages said outer face to lock said adaptor onto said waist band.

According to a preferred embodiment, the second member comprises a flexible tab integral with said first member and which includes a fastener which engages an opposing fastener on said outer surface of said first member. Preferably, the engagement of said part of said first member which folds back on itself forms a through passage to receive said waist band.

In another broad form the present invention comprises:

a pouch for detachable fitting to a waist band belt or the like the pouch comprising;

an adaptor for fitting the pouch to a waist band the adaptor comprising:

a first member having first and second ends, the first end adapted to receive and retain the pouch thereon pouch and the second end terminating in a second member, the first member including an inner face and an outer face, wherein the inner face includes a part which folds back on itself to allow engagement of opposing fasteners; wherein said second member engages said outer face to lock said adaptor onto said waist band.

In its broadest form the present invention comprises:

a pouch for detachable fitting to a waist band belt or the like the pouch comprising;

an adaptor for fitting the pouch to a waist band the adaptor comprising:

a first member having first and second ends, the first end adapted to receive and retain the pouch thereon pouch and the second end terminating in a second member; the first member including an inner face and an outer face, wherein the inner face includes a part which folds back on itself to allow engagement of opposing fasteners to thereby secure said pouch to said belt.

In another broad form of a method aspect the present invention comprises:

a method for detachable fitting of a pouch to a waist band belt or the like the pouch comprising;

an adaptor for fitting the pouch to a waist band the method comprising the steps of:

a) taking a first member having first and second ends, the first member including an inner face and an outer face b) allowing the first end to receive and retain the pouch thereon c) folding a part of the inner face back on itself to allow engagement of opposing fasteners d) allowing a second member to engage said outer face to lock said adaptor onto said waist band.

According to a preferred embodiment each said fasteners is a Velcro strip. Preferably said part of the inner face which is folded back on itself is folded about a fold line.

In another broad form of a method aspect the present invention comprises:

a method for detachable fitting of a pouch to a waist band belt or the like the pouch comprising;

an adaptor for fitting the pouch to a waist band the method comprising the steps of:

a) taking a first member having first and second ends, the first member including an inner face and an outer face;

b) feeding the first member around a belt or other support member;

b) folding a part of the inner face back onto an outer face to allow engagement of a fastener on said inner face with an opposing fastener on said outer face;

d) allowing a second member to engage said inner face to secure said adaptor onto said waist band.

The method comprises the further step of locking the second member using press stud engagement.

In its broadest form the present invention comprises:

an adaptor for fitting to a waist band, the adaptor comprising:

an adaptor body having first and second ends, the first end adapted to receive and retain a pouch and the second end terminating in a fastening assembly, the adaptor body including a first face and an opposing second face; wherein, the second end comprises at least one fastener, the adaptor body formed from a flexible material allowing a portion of the second end to be folded about the waist band.

Preferably, a portion of said second face folds back on itself allowing a portion of the first face to meet at least a portion of the second face in opposing engagement, wherein, the first face meets at least the portion of the second face via a second fold such that the adaptor body forms a closed loop retaining a portion of said waist band.

The at least one fastener preferably engages the first face to secure the closed loop. According to one embodiment, the at least one fastener comprises a flexible tab integral with the first member and which includes a fastener which engages an opposing fastener on said first face. The first fold forms an aperture to receive the waist band. The fastener which engages an opposing fastener on said the first face preferably engages via velcro. Alternative fastening may be used such as co operating studs. The fastener has a first face including Velcro and the first face of the adaptor body includes a region of Velcro opposing the Velcro on the first face. The at least one fastening tab is made from a flexible material, wherein the tab includes a stud which engages a co operating stud.

The at least one fastener locks the loop to prevent unfurling of the loop. In an alternative embodiment there are two fastener locking tabs.

The pouch and adaptor which it is held upon is preferably formed from a crushable material which allows the pouch to be flattened and expanded.

According to one embodiment, the adaptor body is longer than it is wide and the material of construction is a synthetic.

In another broad form according of a method aspect the present invention comprises;

a method of fitting an adaptor formed from a flexible material to a waist band, comprising the steps of;

a) taking an adaptor body having first and second ends, the first end adapted to receive and retain a pouch and the second end terminating in a fastening assembly, the adaptor body including a first face and an opposing second face;

b) taking a fastener located at said second end c) allowing a portion of the second end to be folded about the waist band forming a closed loop thereabout.

A portion of the second face 1 is folded back on itself allowing a portion of the first face to meet at least a portion of the second face in opposing engagement. The first face to meets at least the portion of the second face via a second fold such that the adaptor body forms a closed loop retaining a portion of said waist band.

In another broad form of the method aspect, the present invention comprises:

a method for detachable fitting of a pouch to a waist band belt or the like the pouch comprising;

an adaptor for fitting the pouch to a waist band the method comprising the steps of:

a) taking a first member having first and second ends, the first member including an inner face and an outer face b) allowing the first end to receive and retain the pouch thereon c) folding a part of the inner face back on itself to allow engagement of opposing fasteners d) allowing a second member to engage said outer face to lock said adaptor onto said waist band.

In another broad form the present invention comprises:

a pouch for detachable fitting to a waist band the pouch including, an adaptor for fitting the pouch to a waist band, the adaptor comprising an adaptor body having first and second ends the first end adapted to receive and retain the pouch thereon and the second end terminating in a fastening assembly for detachable fixing said adaptor to said waist band the fastening assembly including opposing first and second faces and at least one fastening member, the second end of the adaptor body having a part which is capable of folding back on itself to allow mutual engagement of said second end of said adaptor so said waist belt.

In a further form the present invention comprises:

A detachable pouch for fitting to a waist band, the pouch comprising;

an adaptor body having first and second ends, the first end adapted to receive and retain the pouch and the second end terminating in a fastening assembly, the adaptor body including a first face and an opposing second face; wherein, the second end comprises at least one fastener, the adaptor body formed from a flexible material allowing a portion of the second end to be folded about the waist band.

DETAILED DESCRIPTION

The present invention will now be described in more detail according to a preferred but non limiting embodiment and with reference to the accompanying illustrations; wherein FIG. 1 shows a perspective view of a developed pouch assembly according to a preferred embodiment.

Figure 1:
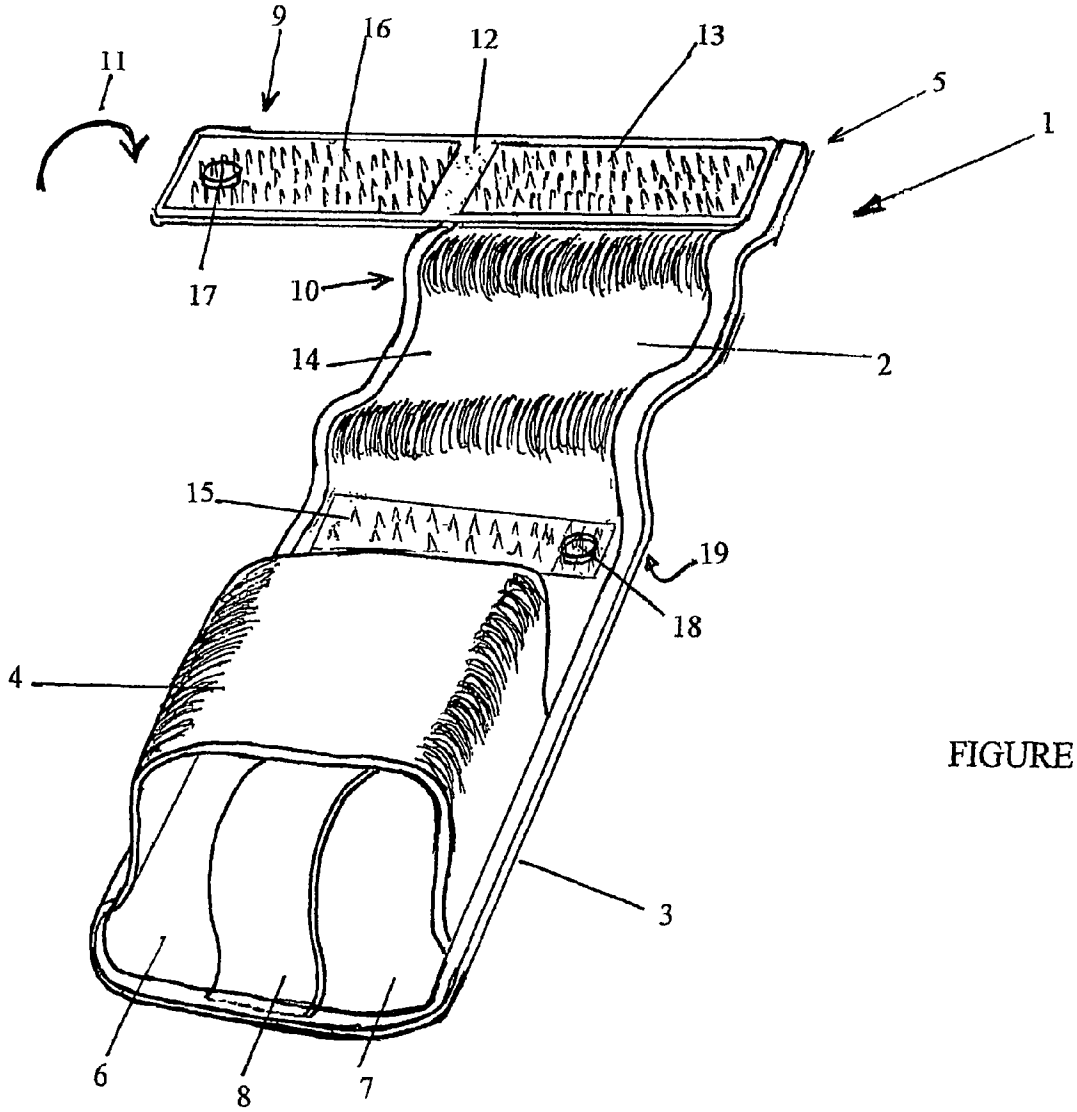

Referring to FIG. 1 there is shown a perspective view of a developed pouch assembly 1 according to a preferred but non limiting embodiment. Assembly 1 comprises: a first generally planar member 2 which is sufficiently flexible to allow folding about fold regions at any location along member 2. Member 2 includes a first end 3 which receives and retains a pouch 4 and a second end 5 which includes connection means for detachable attachment of the pouch assembly to another object such as a waist belt. Pouch 4 is merely an example of a variety of apparatuses which may be attached to planar member 2. Pouch 4 includes openings 6 and 7 separated by divider 8 which allow retention of long handle tools and the like. The present invention is primarily directed to the arrangements at end 5. End 5 of planar member 2 includes an arm 9 which extends from side 10 of planar member 2. Arm 9 is capable of movement through almost 180 degrees in the directions of arrow 11 so that it is capable of folding about pivot point 12. The length of arm 9 may be variable to enlarge or decrease the contact area during attachment. Second end 5 of planar member 2 includes a fastening element 13 which may be a Velcro strip. Element 13 is disposed on surface 14 of planar member 2. A second fastening element 15 is also disposed on surface 14 remote from element 13. Arm 9 includes fastening element 16 and press stud 17 which eventually engages mating stud 18 as will be explained below. Planar member 2 also comprises fastener 19 disposed on surface 20 of planar member 2 and located opposite location of fastener 15.

Figure 2:
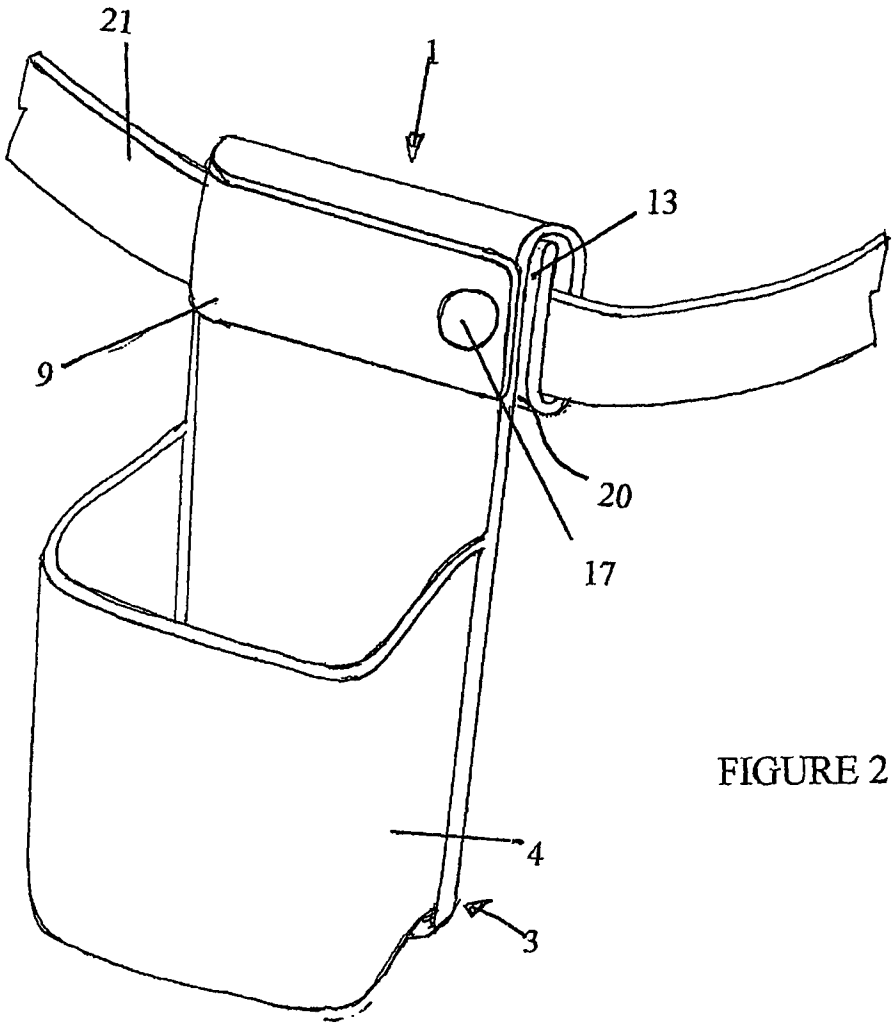
FIG. 2 shows a perspective view of a the assembly of FIG. 1 attached to an abbreviated waist belt.

FIG. 2 shows the assembly of FIG. 1 fitted to a waist belt 21.

In order to fit assembly 1 to a waist belt 21 the following steps are performed. Ideally arm 9 is folded over temporarily so that insertion of the planar member 2 behind waist belt 21 is more convenient. In that case fastening element 16 opposes fastening element 13. This is a temporary state to reduce the width of planar member 2 during fitting to waist belt 21.

Planar member 2 is fed behind belt 21 from above and looped around belt 21 until fastening element 13 opposes fastening element opposes fastening element 19. Before engagement of elements 13 and 19 arm 9 is rotated away from its initial engagement with fastening element 13. One further rotation allows fastening element 13 to engage fastening element 19 (obscured). Arm 9 is then rotated back so that fastening elements 15 and 16 oppose in mating engagement thereby securing assembly 1 onto belt 21. To lock assembly 1 arm 9 includes opposing locking press studs 17 and 18 (see FIG. 1). To release assembly 1 from belt 21 press studs 17 and 18 are released which allows 15 and 16 to disengage. One further rotation allows fastening element 13 to disengage from fastening element 19. This will allow release of the assembly 1 from belt 21.

Figure 3:
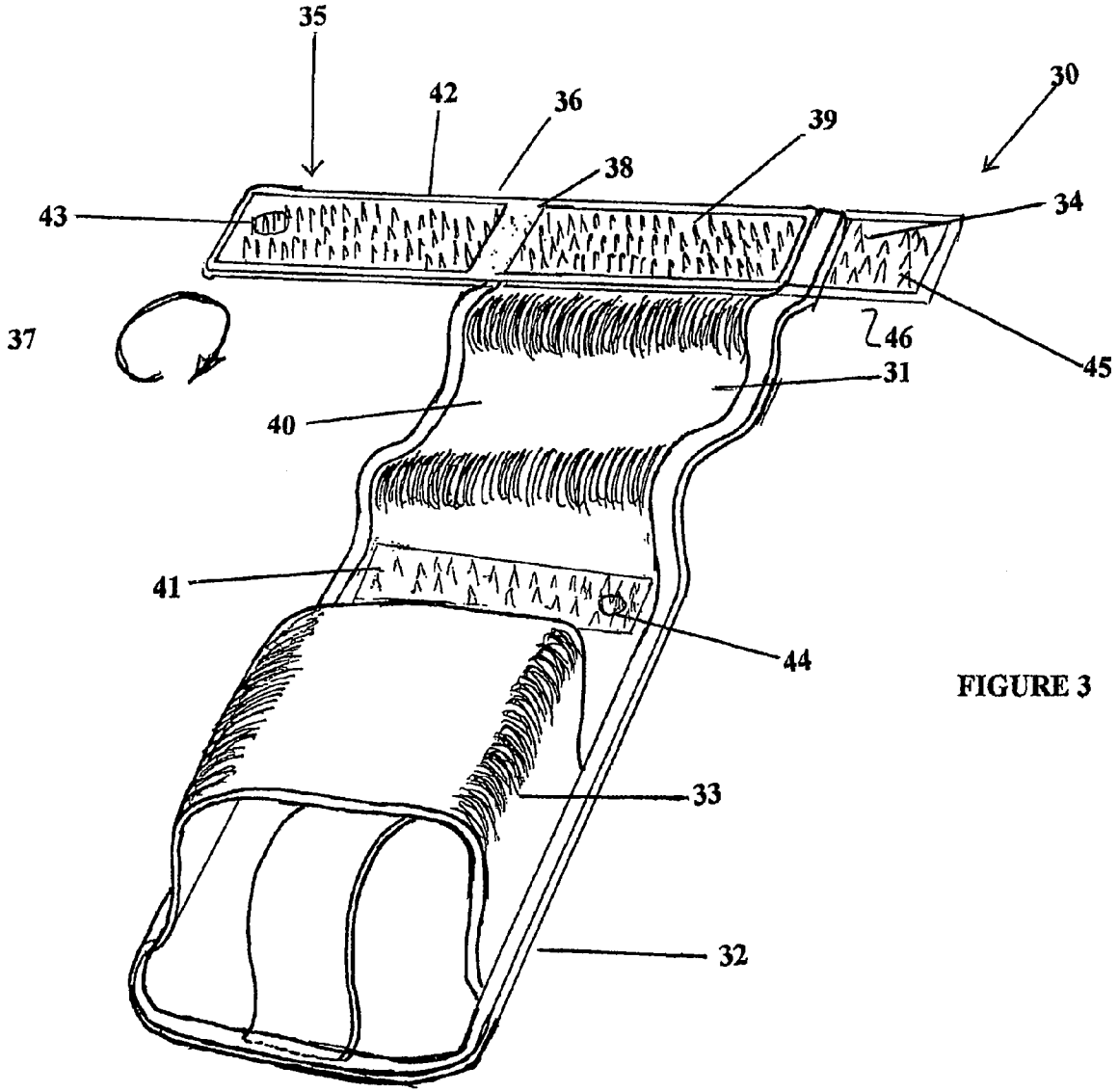
FIG. 3 shows a perspective view of a developed pouch assembly according to an alternative embodiment.

FIG. 3 shows a perspective view of a developed pouch assembly according to an alternative embodiment.

Referring to FIG. 3 there is shown a perspective view of a developed pouch assembly 30 according to a preferred but non limiting embodiment. Assembly 30 comprises: a first generally planar member 31 which is sufficiently flexible to allow folding about fold regions at any location along member 31. Member 31 includes a first end 32 which receives and retains a pouch 33 and a second end 34 which includes connection means for detachable attachment of the pouch assembly to another object such as a waist belt. Second end 34 of planar member 31 includes an arm 35 which extends from side 36 of planar member 31. Arm 35 is capable of movement through almost 180 degrees in the directions of arrow 37 so that it is capable of folding about pivot point 38.

The length of arm 35 may be variable to enlarge or decrease the contact area during attachment. Second end 34 of planar member 31 includes a fastening element 39 which may be a Velcro strip. Element 39 is disposed on surface 40 of planar member 31. A second fastening element 41 is also disposed on surface 40 remote from element 39. Arm 35 includes fastening element 42 and press stud 43 which eventually engages mating stud 44. The assembly of FIG. 3 is characterised in that it includes an additional arm 45 having a fastening surface 46. Arm 45 provides enhanced fastening when assembly 30 is attached to a belt. FIG. 4 shows how arm 45 locks onto an opposing surface via fastening surface 46 to provide additional locking. Arm 45 may be any length but this may be varied depending upon the degree of locking required and contact area to fulfil this objective.

It will be recognized by persons skilled in the art that numerous variations and modifications may be made to the invention as broadly described herein without departing from the overall spirit and scope of the invention.

The claims defining the invention are as follows:

1. An adaptor for fitting a pouch to a waist band, the adaptor comprising:

an adaptor body having first and second ends, the first end adapted to receive and retain a pouch and the second end allowing attachment of the pouch to the waist band;

the adaptor body including a first face and an opposite second face;

the adaptor body being formed from a flexible material allowing a portion of the second end to be folded in a closed loop about the waist band so that part of the first face engages part of the second face; and the second end including at least one fastener extending sideways from the second end of the adaptor body, said at least one fastener retaining the engagement between the first and second faces by being wrapped over the first face near the first end of the adaptor body after the loop is created by folding the adaptor body about the waist band.

2. An adaptor according to claim 1, wherein the adaptor body is formed from a crushable material which allows the pouch to be flattened and expanded.

3. An adaptor according to claim 2, wherein the adaptor body is longer than it is wide.

4. An adaptor according to claim 3, wherein the crushable material of the adaptor body is a synthetic.

5. An adaptor according to claim 1, wherein a portion of said second end folds back on itself allowing a portion of the first face to meet at least a portion of the second face in opposing engagement near the first end of the adaptor body.

6. An adaptor according to claim 5, wherein the at least one fastener comprises a first flexible member integral with the adaptor body.

7. An adaptor according to claim 6, further comprising a second fastener extending sideways from the second end of the adaptor body in an opposite direction from that of the at least one fastener, said second fastener also retaining the engagement between the first and second faces by being wrapped over the first face near the first end of the adaptor body after the loop is created by folding the adaptor body about the waist band.

8. An adaptor according to claim 6, wherein said at least one fastener engages said first face to secure the closed loop.

9. An adaptor according to claim 6 wherein, the closed loop which receives the waist band is formed by said portion of the first face engaging said portion of the second face.

10. An adaptor according to claim 9, wherein the at least one fastener engages the second fastener via a releasable hook and loop fastener system.

11. An adaptor according to claim 10, wherein, the at least one fastener and the second fasteners each have a face including a ones of a releasable hook and loop fastener system.

12. An adaptor according to claim 11, wherein the releasable hook and loop fastener system of the at least one fastener engages the first face of the adaptor body and a face of the second fastener.

13. An adaptor according to claim 12, wherein the at least one fastener includes a stud which engages a co-operating stud.

14. A detachable pouch for detachable fitting to a waist band, the pouch including, an adaptor for fitting the pouch to a waist band, the adaptor comprising an adaptor body having first and second ends, the first end adapted to receive and retain the pouch thereon and the second end terminating in a fastening assembly for detachable fixing of said adaptor body to said waist band, the fastening assembly including a first face and an opposite second face, and at least one fastener extending sideways from the second end of the adaptor body, the second end of the adaptor body having a part which is capable of folding back on itself to form a closed loop and allow mutual engagement of said second end of said adaptor body to said waist belt; and the at least one sideways extending fastener opposing and retaining the first face near the first end of the adaptor body after the loop is created by folding the adaptor body about the waist band.

15. A detachable pouch according to claim 14, wherein the pouch is formed from a crushable material which allows the pouch to be flattened and expanded.

16. A detachable pouch according to claim 15, wherein the adaptor body is longer than it is wide.

17. A detachable pouch according to claim 16, wherein the material of construction of the pouch is a synthetic.

18. A detachable pouch according to claim 14, wherein said at least one fastener includes a fastening tab which engages a co-operating fastener on said first face of said assembly.

19. A detachable pouch according to claim 18, wherein a second fold of the adaptor body allows a portion of said first face to meet at least a portion of the second face in opposing engagement.

20. A detachable pouch according to claim 19, wherein said at least one fastener engages said first face to secure the closed loop.

21. A detachable pouch according to claim 20, wherein the at least one fastener comprises a flexible tab integral with the adaptor body and which includes a fastener system which engages an opposing fastener system on said first face.

22. A detachable pouch according to claim 21, wherein the first fold forms an aperture to receive said waist band.

23. A detachable pouch according to claim 22, wherein the fastener system of the at least one fastener which engages an opposing fastener system on said adaptor body comprise a hook and a loop releasable fastener system.

24. A detachable pouch according to claim 23, wherein the at least one fastener has a first face including a hook and loop releasable fastener system and the first face of the fastening assembly includes a region of a hook and loop releasable fastener system opposing the hook and loop releasable fastener system on the first face of the at least one fastener.

25. A detachable pouch according to claim 24, wherein the at least one fastener is made from a flexible material.

26. A detachable pouch according to claim 25, wherein the at least one fastener includes a stud which engages a co-operating stud on the first face of the fastening assembly.

27. A method of fitting a pouch to a waist band via an adaptor formed from a flexible material, said method comprising the steps of:

a) taking an adaptor body having first and second ends, the first end adapted to receive and retain a pouch and the second end terminating in a fastening assembly, the adaptor body including a first face and an opposite second face;

b) introducing a first fold into a portion of the second end of the adaptor body so that a portion of the second face opposes another portion of the second face;

c) introducing a second fold into the adaptor so that a portion of the first face opposes a portion of the second face to form a closed loop extending around said waist band;

d) taking at least one fastener extending sideways from and connected to the adaptor body and then securing a part of that at least on fastener against a part of the first face of the adaptor body and another part of the at least one fastener against a part of a second fastener.

28. A method according to claim 27, comprising the further step of:

feeding the adaptor body about a belt or other support member prior to folding the adaptor body.

* * * * *